US007770310B2

(12) United States Patent
Keech

(10) Patent No.: US 7,770,310 B2
(45) Date of Patent: Aug. 10, 2010

(54) FASTENING ASSEMBLY

(75) Inventor: Garth Alexander Keech, Bendigo (AU)

(73) Assignee: Keech Castings Austrailia Pty Limited, Silverwater, New South Wales (AU)

( * ) Notice: Subject to any disclaimer, the term of this patent is extended or adjusted under 35 U.S.C. 154(b) by 0 days.

(21) Appl. No.: 12/095,881

(22) PCT Filed: Dec. 1, 2006

(86) PCT No.: PCT/AU2006/001833

§ 371 (c)(1),
(2), (4) Date: Sep. 19, 2008

(87) PCT Pub. No.: WO2007/062484

PCT Pub. Date: Jun. 7, 2007

(65) Prior Publication Data

US 2009/0166051 A1 Jul. 2, 2009

(30) Foreign Application Priority Data

Dec. 2, 2005 (AU) ..... 2005906790

(51) Int. Cl.
*E02F 9/28* (2006.01)

(52) U.S. Cl. ..... 37/455

(58) Field of Classification Search ..... 37/446, 37/450, 451, 455, 456, 460; 172/445.1, 772, 172/701.3, 501, 684.5, 719, 797
See application file for complete search history.

(56) References Cited

U.S. PATENT DOCUMENTS 4,027,408 A * 6/1977 Ramella et al. ..... 37/455
4,668,122 A * 5/1987 Riddle ..... 404/121
5,337,495 A * 8/1994 Pippins ..... 37/453
6,041,529 A * 3/2000 Ruvang ..... 37/446

* cited by examiner

*Primary Examiner*—Robert E Pezzuto
(74) *Attorney, Agent, or Firm*—Kaplan Gilman & Pergament LLP

(57) ABSTRACT

A fastening assembly (1) for releasable securement of first and second components. The assembly includes: a nut (2), having a threaded bore and a shaped outer surface; a retainer (3), associated with said first component, including a slot which is of complementary shape to said outer surface of said nut (2), and which is adapted to receive and retain said nut (2) therein; and, a bolt (4), having a head and a threaded shaft, which is adapted to engage said second component, and be secured to the nut (2) to thereby fasten the first and second components together. The fastening assembly (1) is particularly useful to secure a wearable edge to a bucket of a mining, earthmoving, agricultural or like machinery.

9 Claims, 4 Drawing Sheets

FIGURE 3
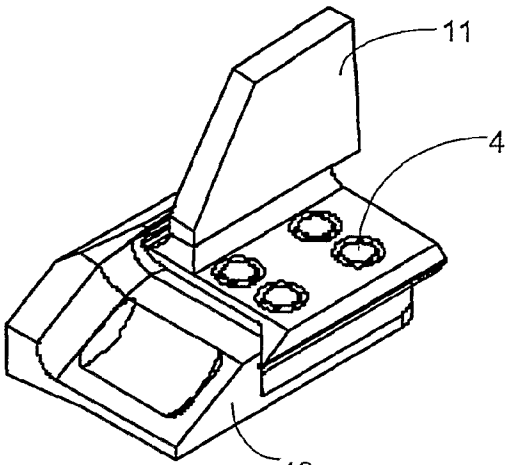
FIGURE 3(a)
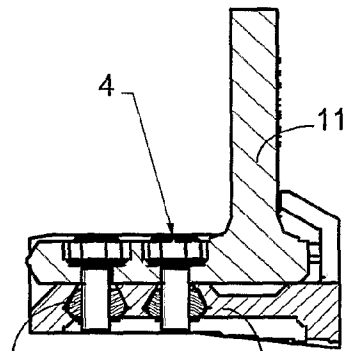
FIGURE 3(d)
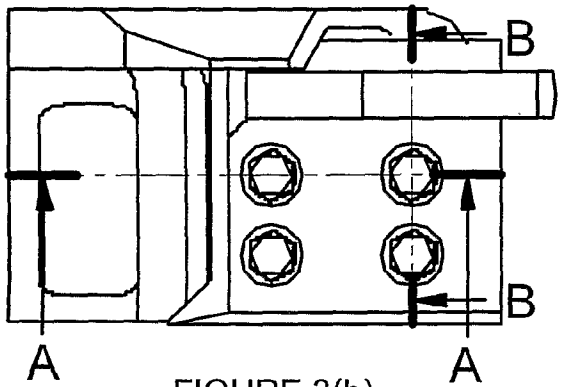
FIGURE 3(b)
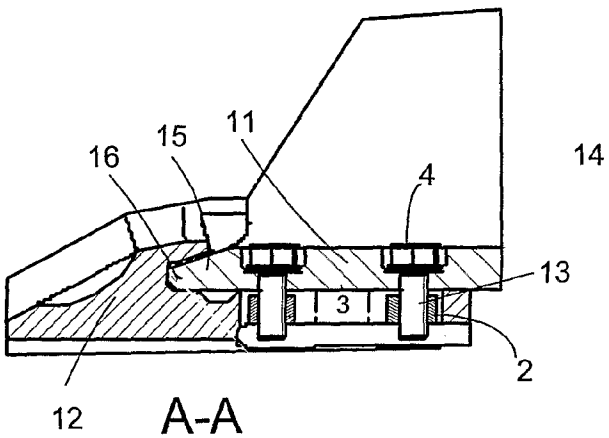
FIGURE 3(c)

FIGURE 4
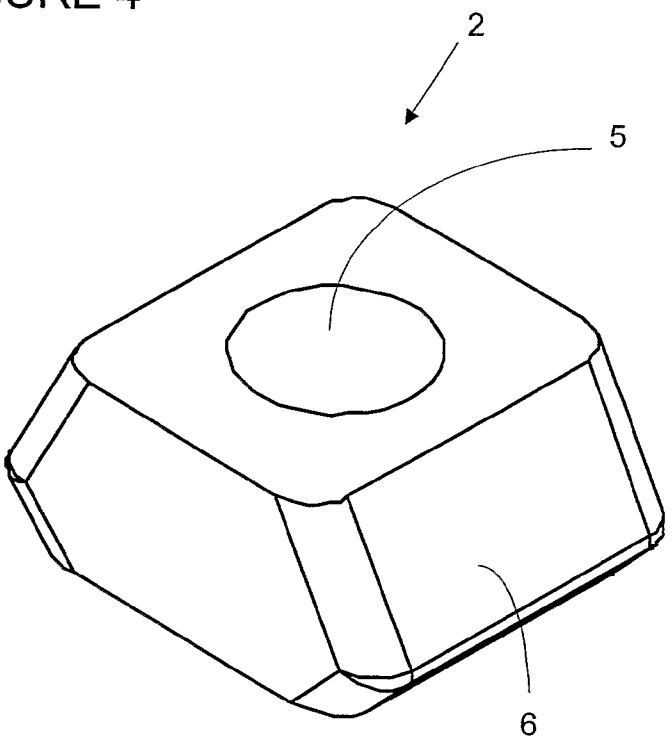
FIGURE 4(a)
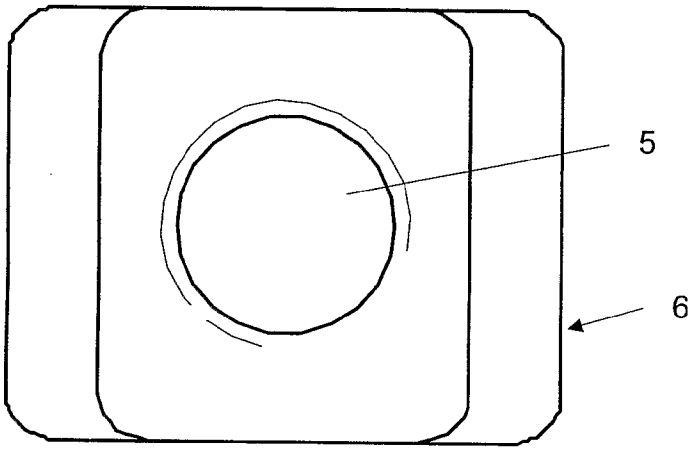
FIGURE 4(b)
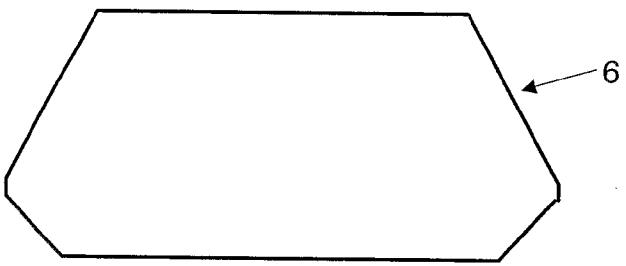
FIGURE 4(c)

FASTENING ASSEMBLY

FIELD OF THE INVENTION

The present invention relates to a fastening assembly for releasably securing first and second components together. In particular, the fastening assembly of the present invention includes a shaped nut, a retainer for receiving and retaining the shaped nut, and which is associated with the first component, and, a bolt which can engage the second component and be secured to the nut, to thereby fasten the first and second components together.

The present invention has particularly useful applications in securing wearable components to heavy equipment, such as typically used in the mining, earthmoving and agricultural industries. For example, the invention may, in a preferred but non-limiting embodiment, be used to attach a wearable edge to the bucket of mining machinery.

BACKGROUND OF THE INVENTION

In the mining, earthmoving and agricultural industries, it is commonplace to attach a wearable edge to a bucket, such that, as the bucket is used and becomes worn, the edge may be replaced without the need to replace the bucket. Traditionally, such wearable edges are welded to the bucket. When the edge is worn, it is then necessary to unweld the edge, and attach a replacement edge to the bucket. This is obviously a time consuming and labour intensive process, resulting in considerable expense associated with the equipment being non-usable during this downtime, and, the need to pay trades people to perform the labour intensive and time consuming welding operations involved.

Whilst the present invention has particular application to this industry, it will be appreciated that the invention should not be limited to such applications, as there are many other applications whereby the fastening assembly may be utilised for quick and easy securement to two components together.

SUMMARY OF THE INVENTION

The present invention seeks to provide a fastening assembly for the quick and easy releasable securement of a first component to a second component.

The present invention also seeks to provide a fastening assembly which may easily releasably secure first and second components without the need for welding.

In one broad form, the present invention provides a fastening assembly for releasable securement of first and second components, said assembly including:

a nut, having a threaded bore and a shaped outer surface;

a retainer, associated with said first component, including a slot which is of complementary shape to said outer surface of said nut, and which is adapted to receive and retain said nut therein; and, a bolt, having a head and a threaded shaft, which is adapted to engage said second component, and be secured to said nut to thereby fasten said first and second components together.

Preferably, said nut is of substantially quadrilateral shape in cross-section in a first plane orthogonal to the axis of said bore.

Also preferably, said nut is of substantially hexagonal shape in cross-section in a second plane, said second plane being orthogonal to both the axis of said bore and to said first plane.

Also preferably, at least some of the edges of said nut are rounded or chamfered.

In a preferred form, said retainer slot includes:

an opening via which said nut is inserted into said slot; and, a channel, having shaped side walls a complementary shape to side walls of said nut;

whereby, said nut may slide within said channel whilst longitudinal and rotational movement in the axial direction of said nut is substantially restricted.

Preferably, said slot includes two or more channels emanating from each opening.

Preferably, said second component includes an orifice, shaped to receive the shaft of each bolt therethrough.

Also preferably, each orifice includes a rebated portion shaped to receive the head of each bolt.

Preferably, said assembly is used to secure a wearable edge to a bucket of a mining, earthmoving, agricultural or like machinery.

BRIEF DESCRIPTION OF THE DRAWINGS

The present invention will become more fully understood from the following detailed description of a preferred but non-limiting embodiment thereof, described in connection with the accompanying drawings, wherein:

FIG. 3 illustrates how two components may be attached together using the fastening system of the present invention, FIG. 3(*a*) showing a perspective view, FIG. 3(*b*) showing a plan view, FIG. 3(*c*) showing a sectional view through line A-A of FIG. 3(*b*), and FIG. 3(*d*) showing a sectional view through line B-B of FIG. 3(*b*); and, FIG. 4 shows, in FIGS. 4(*a*), 4(*b*) and 4(*c*) respectively, a perspective view, a plan view, and, an elevational view, of a preferred embodiment of the nut of the fastening system of the present invention.

DETAILED DESCRIPTION OF PREFERRED EMBODIMENTS

Throughout the drawings, like numerals will be used to identify similar features, except where expressly otherwise indicated.

Figure 1:
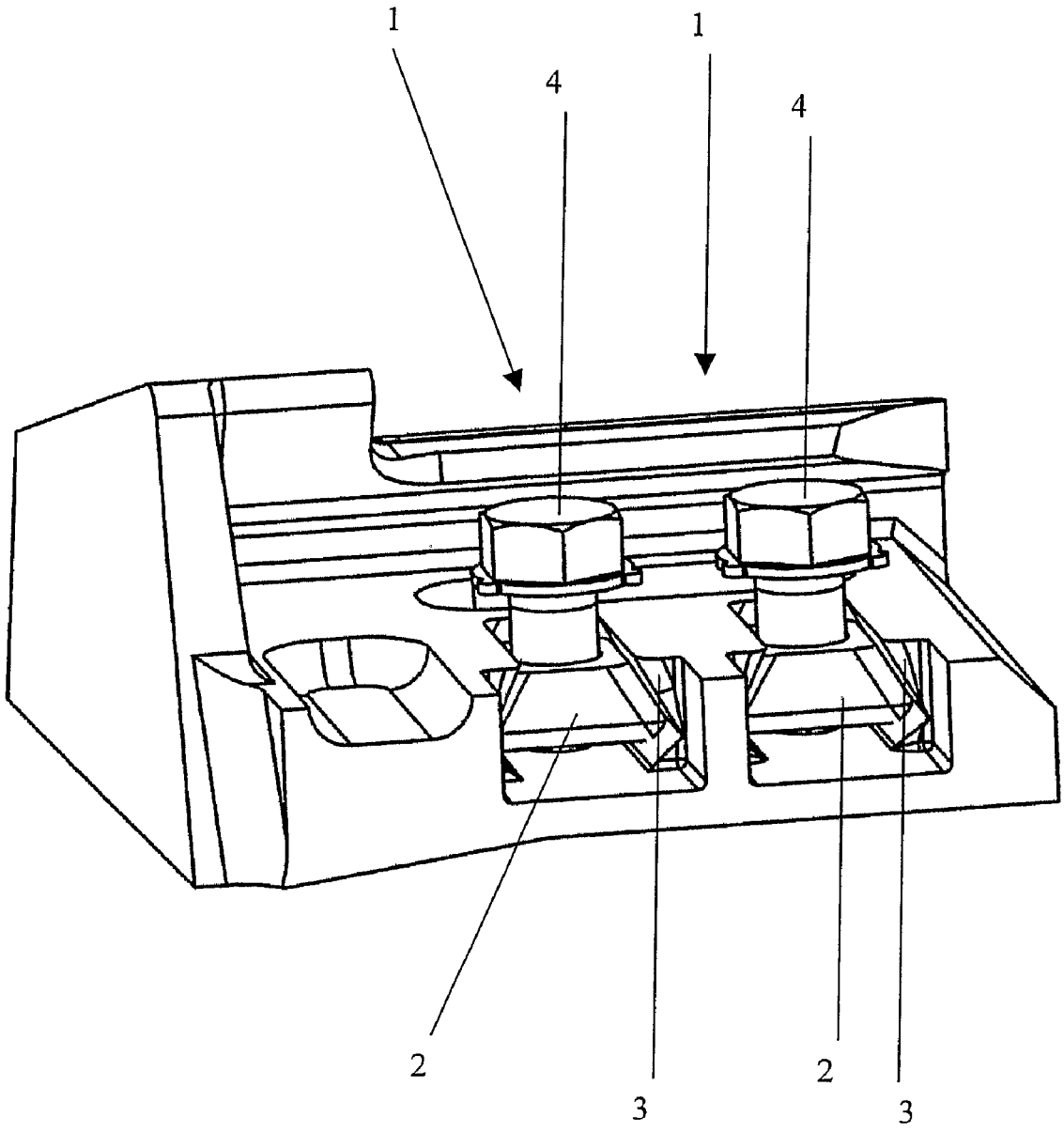
FIG. 1 illustrates a front perspective view of the fastening system in accordance with the present invention.
Figure 2:
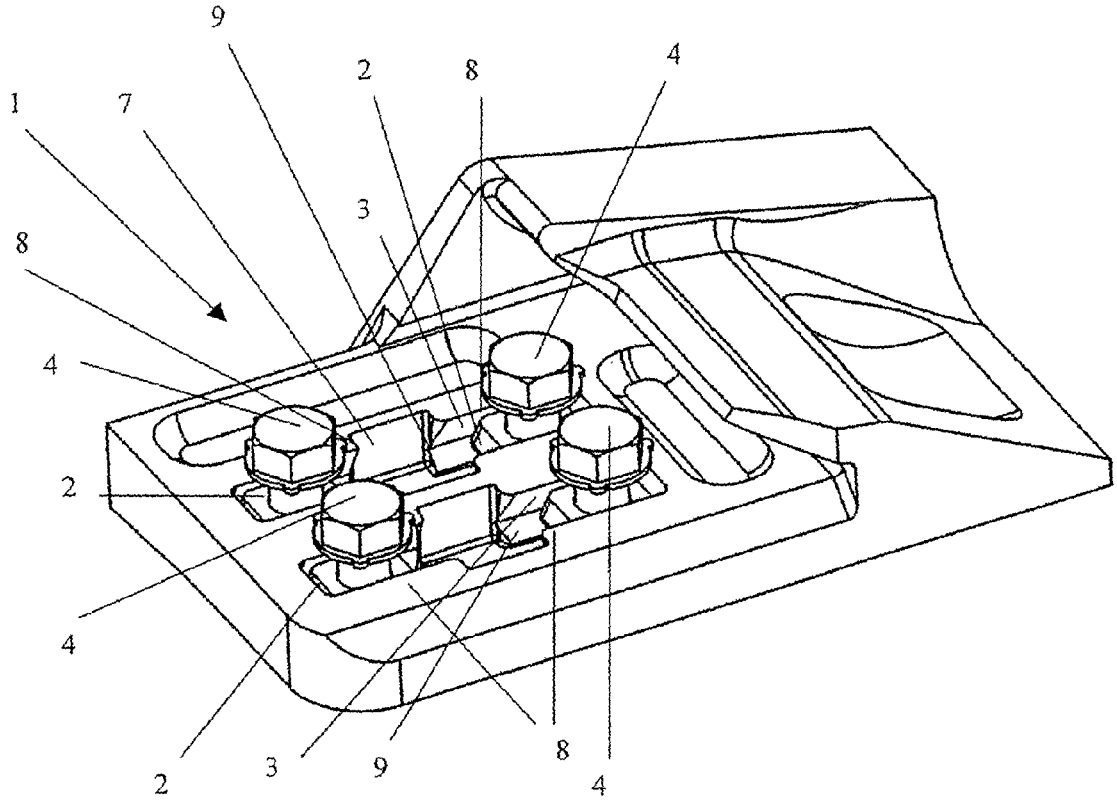
FIG. 2 illustrates as side perspective view of the fastening assembly of the present invention.

As shown in FIG. 1, the fastening assembly of the present invention may be used to releasably secure first and second components. A first of the components is illustrated in FIGS. 1 and 2, whilst the interconnection of the second component is illustrated in FIG. 3.

The fastening system of the present invention, as generally designated by the numeral 1, includes a nut 2, a retainer 3, and bolt 4.

The nut, as best illustrated in FIG. 4, has a threaded bore 5 and a shaped outer surface 6.

In the embodiment shown, the nut may typically be of the general shape of a hexagonal prism, as shown in FIG. 4(*a*). That is, when looking at the nut in cross-sectional in a first plane orthogonal to the axis of the bore, as illustrated in FIG. 4(*b*), the nut may be substantially quadrilateral in shape, having a substantially square upper surface, whilst, when viewing the nut in cross-section in a second plane, which is orthogonal to both the axis of the bore and the first plane, that is, the view shown in FIG. 4(*c*), the nut may be generally of hexagonal shape.

It will, however, be appreciated that a variety of shapes of nut may be provided, for example, rather than protruding angularly, the shaped sides 6 may be curved in shape, or may protrude inwardly rather than outwardly, or, may have appropriate projections thereon. The main requirement is that these sides of the nut are shaped to complement and cooperate with the channel(s) of the slot of the retainer (which will be hereinafter described). A variety of shapes will become apparent to persons skilled in the art.

As shown in FIG. 4, at least some of the edges of the nut between the various outer surfaces may preferably be rounded or chamfered, to allow the nut to be easily positioned within and slid along the channel of the slot (as hereinafter described).

The retainer, which receives and retains the nut 2 therein, as shown in FIGS. 1 and 2, may be formed integrally with or separately to, but associated with the first component (which is to be secured to the second component). Specifically, the retainer includes a slot which is of complementary shape to the outer surface of the nut 2, such that it is adapted to receive and retain the nut 2 therein.

The slot 3 more specifically includes an opening 7 into which the nut 2 may be inserted into the slot 3, and, a channel 8, which has shaped side walls 9 of complementary shape to the side walls 6 of the nut 2, such that, once the nut 2 is inserted into the slot 3, the nut may slide within the channel 8, whilst, transverse and rotational movement in the axial direction of the nut is substantially restricted.

In the preferred embodiment illustrated in the drawings, the slot may incorporate two channels 8, emanating from a single opening 7. It will be appreciated by persons skilled in the art that any number of channels may emanate from each opening.

The second component, which is adapted to be secured to the first component is illustrated in FIG. 3, by reference numeral 11, whilst the first component is illustrated by reference numeral 12. The second component typically includes one or more orifice 13 which is shaped to receive the threaded shaft of the bolt 4 therethrough. Preferably, the orifice also includes a rebated portion 14 which is shaped to receive the head of each bolt 4.

The fastening assembly of the present invention may typically be used to secure a wearable edge of a mining, earthmoving or agricultural type equipment to a bucket. It will clearly be understood by persons skilled in the art that such wearable edges are used on the high impact edges of such equipment, and when they become worn, are replaced. Rather than having to weld the edge onto the bucket, as is commonly done in prior art equipment, the utilisation of the fastening assembly of the present invention has significant advantages. Not only is the time consuming and labour intensive exercise of welding eliminated, but the utilisation of the innovative fastening assembly of the present invention allows the two components to be simply and quickly attached without the need for any specialised tools.

In the embodiment shown in FIG. 3, that is, attaching a wear edge to a mining, earthmoving or agricultural equipment, it will be seen that the components 11 and 12 are held in close contact. The first component 11 includes a forwardly protruding edge 15 which is adapted to be slid into a correspondingly shaped cutout 16 provided in the second component 12, such that the engagement between the edge 15 and the cutout 16, that is, between the first and second components (in this case the edge to the bucket lip) takes away any undue pressure or stresses off the retaining bolts 4, during use. Due to the unique design of the fastening system of the present invention, particularly the ability of the components to slide relative to the fastening system, before the fastening system is tightened, the components may be assembled and positioned with the edge 15 engaged in the cutout 16 for optimal contact, and then, the bolt 4 may be tightened into the nut 2 to thereby secure the components in this position. This ultimately allows a much tighter fit to be provided.

The design of the component features of the fastening assembly of the present invention also allows the bolt to self-align and find the best position for tensioning without horizontal load being applied to the bolt, and this also decreases the chance of the nut and bolt becoming loose. This also allows for manufacturing errors due to the sliding nut self aligning with the bolts.

The nut of the fastening system is housed within the system and may typically wear away with the edge. The design of the fastening system is such that it is flush mounted and does not protrude and interfere with the working surface of the equipment.

The design of the system also provides an improved safety factor, as persons do not to have to work from underneath the bucket or like equipment to install the components, but rather, the components way be installed from the upper surface.

In particular, it will be understood by persons skilled in the art that, during assembly, the nuts 2 may be easily inserted into the slot 7 and slid in channels 8 into the required positions. The other component may then be attached and positioned and then the bolts 4 may be easily inserted through their orifices in the second component to meet with the nuts 2 of the first component. The design of the nuts 2 enables limited movement of the nuts within the channels, whilst, when the bolts are tightened into the nuts, any substantial movement is restricted.

The present invention therefore provides a fastening assembly which eliminates welding, does not require hammering, and does not require and specialised tools or skills for removal or installation of the components. The design of the system furthermore does not protrude and interfere with the working of the equipment, that is, the fastening system is housed within the equipment components and is designed to wear away with the equipment.

As previously mentioned, the particular shapes of the nuts and channels may vary, and such variations will become obvious to persons skilled in the art. The important feature is that the side edges of the nuts and the side edges of the channels cooperate such that slidable movement is permitted in one direction, whilst transverse movement is restricted in other directions, including rotational movement, such that the bolt may be tightened into the nut.

All such variations and modifications which become apparent to persons skilled in the art should be considered to fall within the scope of the invention as broadly hereinbefore described and as hereafter claimed.

The invention claimed is:

1. A fastening assembly for releasable securement of first and second components, said assembly including:

a nut, having a threaded bore and a shaped outer surface having at least one tapering face;

a retainer, associated with said first component, including a slot which is of complementary shape to said outer surface of said nut which has a tapering face conforming to said tapering face of said outer surface, and which is constructed to receive and retain said nut therein with said tapering faces in sliding contact, said retainer slot including:

an opening via which said nut is inserted into said slot; and, a channel, having shaped side walls a complementary shape to side walls of said nut, one of said side walls having said tapering surface;

whereby, said nut may slide within said channel whilst longitudinal and rotational movement in the axial direction of said nut is substantially restricted; and a bolt, having a head and a threaded shaft, which is adapted to engage said second component, and be secured to said nut to thereby fasten said first and second components together.

2. A fastening assembly as in claim 1, wherein said nut is of substantially quadrilateral shape in cross-section in a first plane orthogonal to the axis of said bore.

3. A fastening assembly as in claim 2, wherein said bolt is of substantially hexagonal shape in cross-section in a second plane, said second plane being orthogonal to both the axis of said bore and to said first plane.

4. A fastening assembly as claimed in any one of claims 1 to 3, wherein said nut includes at least one rounded or chamfered edge.

5. A fastening assembly as claimed in claim 1, wherein said slot includes a plurality of channels emanating from each opening.

6. A fastening assembly as claimed in any one of claims 1 to 3, wherein said second component includes an orifice shaped to receive the shaft of each bolt there through.

7. A fastening assembly as claimed in claim 6 wherein each orifice includes a rebated portion shaped to receive the head of each bolt.

8. A fastening assembly as claimed in any one of claims 1 to 3, wherein said assembly is used to secure a wearable edge to a bucket of a mining, earthmoving, or agricultural machinery.

9. A fastening assembly in accordance with claim 1 wherein:

said slot is formed below a contact surface of said first component, said first component having a perimeter and a bounding wall projecting from the perimeter, in opposed relationship to the contact surface, and inwardly to form a perimeter channel;

said second component having a perimeter and a contact surface contacting said first component contact surface when said components are fastened together, said second component perimeter being shaped to be received in said perimeter channel when said components are fastened together;

said perimeter channel and second component perimeter, upon fastening together of the two components, bearing substantial stress in use, whereby substantially reduced stress is born by the bolt.

* * * * *